United States Patent [19]

Scheffel

[11] 4,132,491

[45] Jan. 2, 1979

[54] RESTRAINT ASSEMBLY FOR BRIDGE ROADWAY EXPANSION JOINTS

[75] Inventor: Carl W. Scheffel, Ellicott City, Md.

[73] Assignee: Fox Industries, Inc., Baltimore, Md.

[21] Appl. No.: 900,710

[22] Filed: Apr. 27, 1978

[51] Int. Cl.[2] ..... E01C 11/02

[52] U.S. Cl. ..... 404/68; 404/56

[58] Field of Search ..... 404/69, 68, 56; 52/396; 14/16.5

[56] References Cited

U.S. PATENT DOCUMENTS

| | | | |
|---|---|---|---|
| 3,397,856 | 8/1968 | Sullivan | 14/16.1 X |
| 3,698,292 | 10/1972 | Koester | 14/16.5 |
| 3,788,758 | 1/1974 | Scheffel | 404/56 |
| 3,830,583 | 8/1974 | Becht | 404/69 |
| 3,880,540 | 4/1975 | Rizza | 404/69 |
| 3,904,303 | 9/1975 | Becht | 404/68 |
| 3,907,443 | 9/1975 | McLean | 404/56 |
| 4,030,156 | 6/1977 | Raymond | 14/16.5 |
| 4,058,867 | 11/1977 | Puccio | 14/16.5 |

*Primary Examiner*—Nile C. Byers, Jr.
*Attorney, Agent, or Firm*—Edward F. Levy

[57] ABSTRACT

A restraint assembly for bridge roadway expansion joints incorporates elastomer pads which resiliently mount a center channel of the expansion joint on a transverse support member thereby eliminating metal-to-metal contact and the production of objectionable noise.

9 Claims, 3 Drawing Figures

RESTRAINT ASSEMBLY FOR BRIDGE ROADWAY EXPANSION JOINTS

The present invention relates generally to expansion joints used to connect sections of bridge roadways and more particularly to an expansion joint featuring a restraint assembly having resilient elements resulting in the elimination of objectionable noise.

The prior art related to expansion joints for bridge roadways includes expansion joints which comprise a plurality of metal channels cushioned by elastomer seals and supported by a support bar in a manner which permits the joint to undergo expansion, contraction and rotation. An objection to this type of joint has been the noise which is produced by metal-to-metal contact between the metal channels and the support bar as traffic moves over the joint.

The device shown in U.S. Pat. No. 3,788,758 attempts to overcome the deficiencies of the prior art by providing a hold-down device which incorporates resilient pads in an attempt to cushion the support bar. According to U.S. Pat. No. 3,788,758 the expansion joint comprises a pair of end channels and a center channel each of which run the width of a roadway. Compression seals are disposed between the end channels and the center channel. The channels rest on the top of a support bar which runs transversely to the channels. The support bar, according to the above cited patent, is secured by hold-down assemblies which include an elastomer pad disposed between the bottom of the support bar and the channels. The use of elastomer pads only on the bottom of the support bar results in limited flexibility of the expansion joint and metal-to-metal contact within the joint which leads to the production of road noise when traffic moves over the joint.

The present invention overcomes the limitations of the prior art by providing an expansion joint having a restraint assembly which features an adjustable resilient member connecting the center channel and the support bar. The device according to the present invention eliminates the problem of metal-to-metal contact within the joint and provides a flexible construction having a high degree of structural integrity and safety. The restraint assembly incorporates a tube member which encircles the support bar and resilient pads positioned between the top of the support bar and the tube and between the bottom of the support bar and the tube.

The lower portion of the tube includes a bearing plate which supports the lower resilient pad and an adjustment screw which is operated to adjust the position of the lower resilient pad to take up clearances within the restraint assembly. The bearing plate includes restraint bars positioned adjacent to the sides of the lower resilient pad to retain the pad in position. The upper portion of the tube includes a pin which projects into a cavity formed in an adjacent portion of the upper resilient pad and which positions and retains the upper resilient pad.

It is a principle object of the present invention to provide an expansion joint for bridge roadways having a restraint assembly incorporating resilient pads which eliminates objectional noise and which allows movement necessary for expansion and contraction.

Another object of the present invention is to provide a restraint assembly for use on an expansion joint which combines resilient construction with a high degree of mechanical integrity and safety.

Still another object of the present invention is to provide a restraint assembly for use on expansion joints which incorporates a small number of relatively simple parts which are economical of manufacture.

Additional objects and advantages of the invention will become apparent during the course of the following specification when taken in connection with the following drawings in which.

Figure 1:
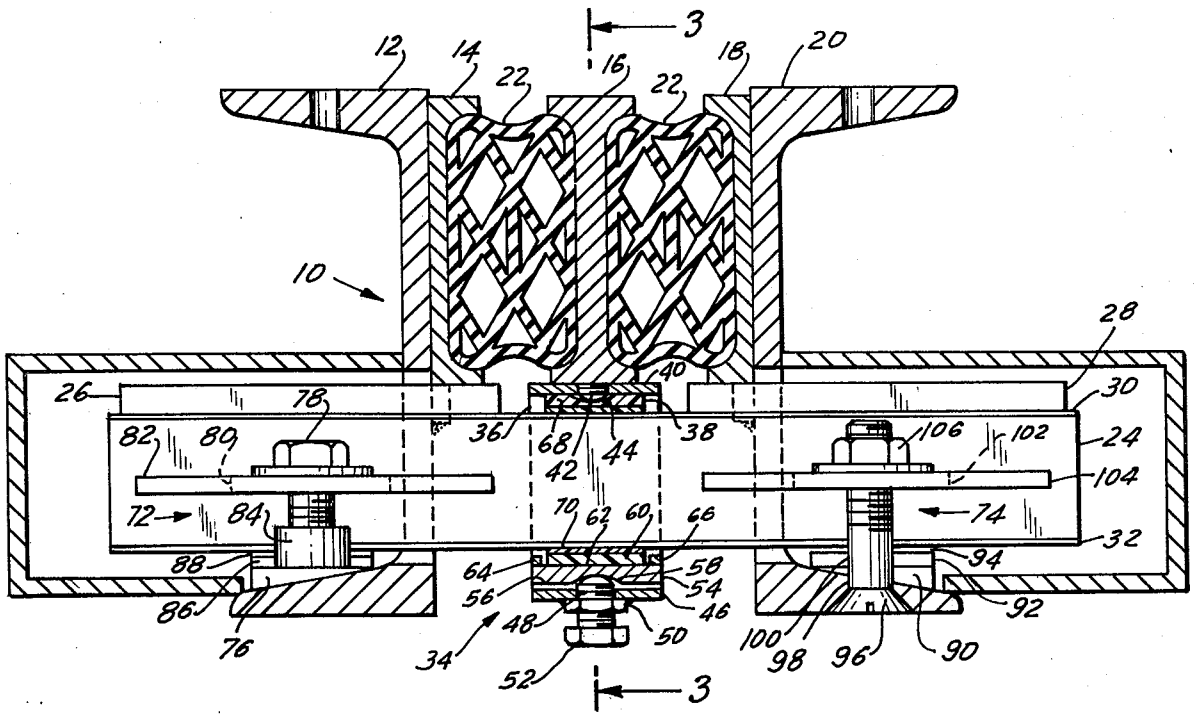
FIG. 1 is a cross-sectional view of an expansion joint for bridge roadways incorporating a restraint assembly according the present invention.

Referring to FIG. 1, there is shown a cross sectional view of an expansion joint 10 for bridge roadways. The expansion joint 10 includes metal channels 12, 14, 16, 18 and 20 which run the width of the roadway. These channels are cushioned by compression seals 22 which are disposed between channels 14 and 16 and between channels 16 and 18.

The channels 14, 16 and 18 overlie the top of a support bar 24 and are supported thereby. A pair of low friction wear strips 26 and 28 are bonded to a 20 gage stainless steel plate 30 which is bonded to the top of the support bar 24. The channels 14 and 18 rest on the low friction wear strips 26 and 28. A 20 gage stainless steel plate 32 is bonded to the bottom surface of the support bar 24.

Figure 2:
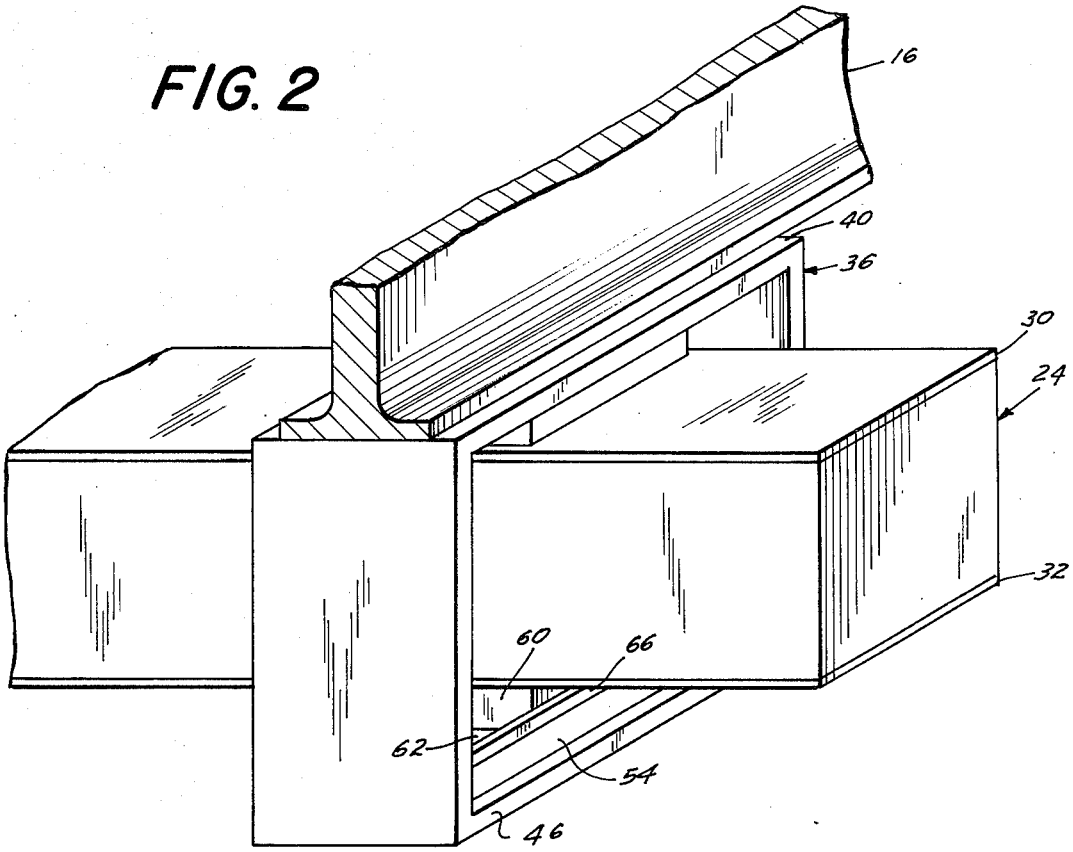
FIG. 2 is a fragmentary perspective view of the restraint assembly according the present invention; and, FIG. 3 is a cross sectional view taken along the line 3—3 in FIG. 1.
Figure 3:
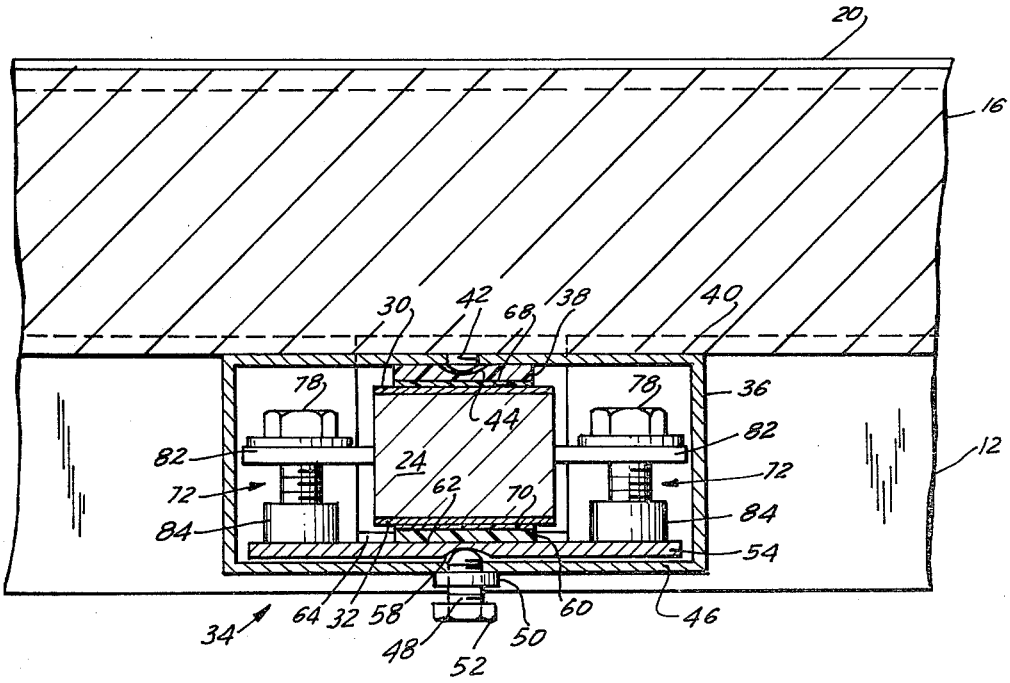

The restraint assembly 34 according to the present invention comprises a rectangular tube 36, shown best in FIG. 2, which is welded to the bottom of channel 16.

An upper resilient pad 38 is disposed between the support bar 24 and the top plate 40 of the rectangular tube 36. A set screw 42 is threaded into the top plate 40 of rectangular tube 36 and projects downwardly into a cavity 44 formed in the upper resilient pad 38. The set screw 42 serves as a retainer pin and prevents the upper resilient pad 38 from moving in a lateral direction.

The bottom plate 46 of the rectangular tube 36 has a central threaded aperture 48 and a locknut 50 welded in registry therewith. A set screw 52 is threaded through the locknut 50 and the bottom plate 46. The set screw 52 projects upwardly and bears against a bearing plate 54. The bottom surface 56 of the bearing plate 54 has a cavity 58 which accepts the set screw 52. A lower resilient pad 60 is bonded to the top surface 62 of the bearing plate 54, and this lower resilient pad 60 bears against the stainless steel plate 32 which is bonded to the bottom surface of the support bar 24. Mounted on the lower side edges of the bearing plate 54 are retainer bars 64 and 66 which prevent lateral motion of the lower resilient pad 60. The set screw 52 provides the capability for vertical adjustment of the bearing plate 54 to take up construction tolerances and provide a close fit between the upper and lower resilient pads 38, 60 and the support bar 24.

The resilient pads 38 and 60 may be made of any one of a number of suitable elastomer materials. In a preferred embodiment the resilient pads are made of fabric reinforced elastomer such as Fabreeka and a thin sheet of polytetraflouroethylene, i.e. Teflon, is bonded to the bottom of the upper resilient pad 38 and to the top of the lower resilient pad 60 so that one Teflon sheet 68 is in contact with the stainless steel plate 30 and other Teflon sheet 70 is in contact with the stainless steel plate 32.